US006739917B2

(12) United States Patent
Croise et al.

(10) Patent No.: US 6,739,917 B2
(45) Date of Patent: May 25, 2004

(54) LINE CONNECTOR WITH PERMANENT OR TEMPORARY SCREW CLAMP

(75) Inventors: Franck Croise, Sille le Guillaume (FR); Dominique Deneu, Le Mans (FR); Olivier Dixneuf, Sille le Guillaume (FR); Loic Perruisseau-Carrier, Le Mans (FR)

(73) Assignees: Legrand, Limoges (FR); Legrand SNC, Limoges (FR)

( * ) Notice: Subject to any disclaimer, the term of this patent is extended or adjusted under 35 U.S.C. 154(b) by 0 days.

(21) Appl. No.: 10/260,502

(22) Filed: Oct. 1, 2002

(65) Prior Publication Data

US 2003/0027458 A1 Feb. 6, 2003

Related U.S. Application Data

(62) Division of application No. 09/583,722, filed on May 30, 2000, now Pat. No. 6,517,388.

(30) Foreign Application Priority Data

May 27, 1999 (FR) ..... 99 06696

(51) Int. Cl.[7] ..... H01K 13/04

(52) U.S. Cl. ..... 439/697; 439/100; 439/782; 439/814

(58) Field of Search ..... 439/100, 789, 439/620, 404, 676, 378, 697, 891, 814, 781, 782, 811, 812

(56) References Cited

U.S. PATENT DOCUMENTS

| | | | | |
|---|---|---|---|---|
| 3,501,738 A | | 3/1970 | Tolliver | |
| 3,675,181 A | * | 7/1972 | Lankford et al. | 439/581 |
| 3,688,248 A | | 8/1972 | Modrey | |
| 3,805,108 A | | 4/1974 | Suzuki | |
| 3,818,278 A | | 6/1974 | Adler | |
| 3,984,170 A | | 10/1976 | Marechal | |
| 4,025,150 A | * | 5/1977 | Nordberg et al. | 439/218 |
| 6,019,642 A | | 2/2000 | Nagata | |
| 6,109,937 A | | 8/2000 | Bonilla et al. | |

* cited by examiner

*Primary Examiner*—Tho D. Ta
*Assistant Examiner*—James R. Harvey
(74) *Attorney, Agent, or Firm*—Young & Thompson

(57) ABSTRACT

A line connector, such as a socket outlet or plug, includes at least one contact member such as a receptacle or pin and at least one connecting terminal which is electrically connected to the contact member and to which an electrical conductor can be connected. The connecting terminal has a tail which can be forcibly fitted into a tubular member for connecting a connecting terminal electrically to the contact member. Applications include demountable plugs and sockets.

20 Claims, 2 Drawing Sheets

LINE CONNECTOR WITH PERMANENT OR TEMPORARY SCREW CLAMP

This application is a division of application Ser. No. 09/583,722, filed on May 30, 2000, now U.S. Pat. No. 6,517,388, the entire contents of which are hereby incorporated by reference.

BACKGROUND OF THE INVENTION

1. Field of the Invention

The present invention relates generally to connectors generally referred to as "line connectors" in the sense that they do not form an integral part of an electrical appliance of any kind and are not intended to be fitted permanently to any such electrical appliance or to any other support and can therefore be moved around.

This can equally well refer to an individual plug or socket outlet at the end of an extension cable or a multisocket outlet incorporating a plurality of such socket outlets connected in parallel.

2. Description of the Prior Art

Be this as it may, a line connector of the kind in question includes at least one contact member, such as a receptacle or pin, adapted to receive a complementary line connector, and at least one connecting terminal which is electrically connected to the contact member and adapted to connect any electrical conductor thereto.

The present invention relates more particularly to the connection terminal or more generally to the connection means employed to make the necessary connection.

The standards covering line connectors of the kind in question distinguish demountable products from non-demountable products, in terms of the connection means.

Demountable products must be equipped with screw terminals so that they can be easily connected to an electrical cable using ordinary tools, in this instance an ordinary screwdrivers in particular in the event of possible re-use.

In contrast, in non-demountable products, i.e. products which must not be re-used in this way, screw terminals are prohibited and must be replaced by connecting means capable of permanent attachment, for example by brazing, welding or crimping.

As a result, at present, and depending on whether they are for demountable or non-demountable products, line connectors of the kind in question must be manufactured in two substantially different ways, which is costly.

A general object of the present invention is an arrangement enabling some degree of standardization of manufacture, with attendant other advantages.

SUMMARY OF THE INVENTION

The invention provides a line connector, such as a socket outlet or plug, including at least one contact member such as a receptacle or pin and at least one connecting terminal which is electrically connected to the contact member and to which an electrical conductor can be connected, wherein the connecting terminal has a tail adapted to be forcibly fitted into a tubular member adapted to connect a connecting terminal electrically to the contact member.

Thus if the line connector is to constitute a demountable product, the connecting terminals provided in accordance with the invention are used and in practice are screw terminals.

On the other hand, if the line connector is to constitute a non-demountable product, the connecting terminals are omitted and the conductors of the cable are connected directly by means of the corresponding tubular members, for example by crimping.

However, in all other respects, and in particular with regard to making an electrical connection between a tubular member of this kind and the corresponding contact member, the components employed can advantageously and economically be the same in both cases.

Also, when connecting terminals in accordance with the invention are used, it is advantageously possible to orient any of them as required during assembly without this requiring a specific operation.

The features and advantages of the invention will emerge from the following description, which is given purely by way of example and with reference to the accompanying diagrammatic drawings.

DETAILED DESCRIPTION OF THE PREFERRED EMBODIMENTS

The figures show, by way of example, the situation in which the line connector 10 according to the invention is a plug intended to be removably fitted to one end of an electrical cable, for example an extension cable, which is not shown.

Figure 1:
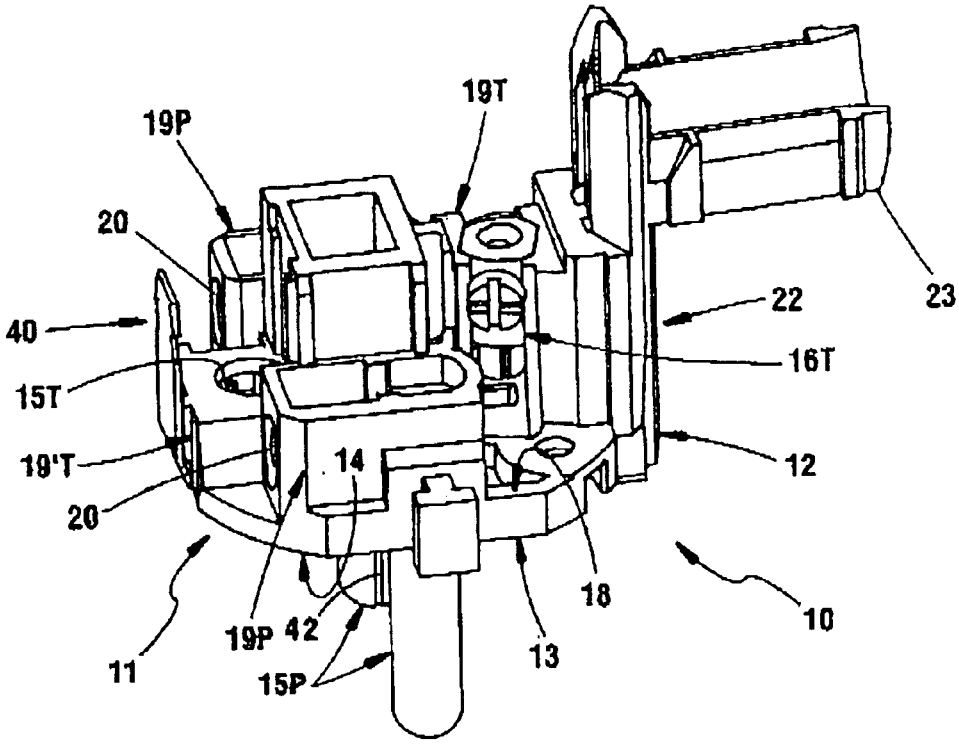
FIG. 1 is a perspective view of the mechanism of a line connector according to the invention.

A line connector 10 of this kind is well known in the art and for this reason is not described in complete detail here, and FIG. 1 shows only its active part, i.e. the mechanism 11.

In a manner that is known in the art, the mechanism 11 is based on an insulative material block 12 whose base forms a plate 13 of which only the outside surface 14 can normally be seen, the line connector 10 being completed by a cover, not shown, which covers it entirely.

In a manner known in the art, the line connector 10 according to the invention includes at least one contact member 15P, 15T such as a receptacle or pin and at least one connecting terminal 16P, 16T electrically connected to the corresponding contact member 15P, 15T, as described in more detail below, and adapted to be connected to an electrical conductor of an electrical cable to which the connector is to be attached.

In the embodiment shown, the plug that the line connector 10 according to the invention constitutes is a two-pin+ ground terminal plug, for example.

Thus in this embodiment the line connector 10 according to the invention has three contact members 15P, 15T, namely two contact members 15P which form pins and a contact member 15T which forms a ground receptacle.

The contact members 15P project parallel to each other from the outside surface 14 of the plate 13 of the insulative material block 12 and the contact member 15T opens onto that outside surface 14.

The line connector 10 according to the invention has three connecting terminals 16P, 16T, one for each contact member 15P, 15T.

The insulative material block 12 forms two housings 19P for the connecting terminals 16P which project from the inside surface 18 of its plate 13 and each of which is in the general form of a well. The wells are parallel to each other, spaced from each other and in practice in vertical alignment with the respective contact members 15P concerned in the position shown here.

For reasons explained later, each housing 19P has a hole 20 in its side.

The insulative material block 12 also forms a housing 19T for the connecting terminal 16T projecting from the inside surface 18 of its plate 13.

In practice, it is at a distance from the contact member 15T concerned and the insulative material block 12 therefore forms a housing 19'T for the contact member 15T which also projects from the inside surface 18 of its plate 13.

In the embodiment shown, the housing 19'T is in the general form of a well, like the previous housings 19P.

However, the housing 19T is laterally open on two opposite sides.

Finally, in the embodiment shown, the insulative material block 12 also forms a pillar 22 which projects from the inside surface 18 of its plate 13 and in practice adjoins the housing 19T for the connecting terminal 16T. From its upper part extends cantilever-fashion a channel 23 adapted to form with a similar channel provided for this purpose on the associated cover a tube to receive the electrical cable to which the connector is to be attached.

The above arrangements are well known in the art and/or are not relevant to the present invention and so are not described in more detail here.

Only the components of the line connector 10 necessary to understanding the invention are described hereinafter.

According to the invention, the connecting terminals 16P, 16T for at least one of the contact members 15P, 15T have a tail 24 by which they are force fitted into a tubular member 25P, 25T and the connecting terminals 16P, 16T are electrically connected via the tubular members 25P, 25T to the corresponding contact members 15P, 15T.

In practice this applies to each of the contact members 15P, 15T.

In practice the connecting terminals 16P, 16T are all identical to each other.

For this reason only one of them, in this instance a connecting terminal 16P, is described hereinafter, with reference to FIGS. 2 and 3.

According to the invention, the connecting terminal 16P is a screw terminal, i.e. a connecting terminal including a metal body 26 with a longitudinal bore 27 and a screwthreaded transverse bore 29 into which a screw 30 is screwed.

In the embodiment shown, the body 26 has two flats 31 at diametrally opposite positions on its outside for immobilizing it in the corresponding housing 19P, 19T.

The tail 24 is parallel to the bore 27, for example, and as shown here.

To be more precise, it extends from a blind end 32 of the bore 27 and projects from the corresponding transverse outside surface of the body 26.

In practice the tail 24 is not coaxial with the bore 27 because the latter is off-center in the body 26 to leave a maximum thickness of material on the side receiving the screw 30.

However, it is globally coaxial with it.

The free end of the tail 24 is preferably tapered to facilitate its insertion into the corresponding tubular member 25P, 25T.

The tail 24 is tapered by a frustoconical bevel 33, for example, and as shown here.

However, it could instead be rounded.

As is the case in the embodiment shown, the tail 24 is preferably made in one piece with the body 26.

Finally, the tail 24 is solid in the embodiment shown.

However, it could instead be at least partly hollow, for example tubular.

The tubular member 25P, 25T for at least one of the contact members 15P, 15T is in one piece with the corresponding contact member 15P, 15T.

In the embodiment shown, this applies to each of the contact members 15P, 15T.

Figure 2:
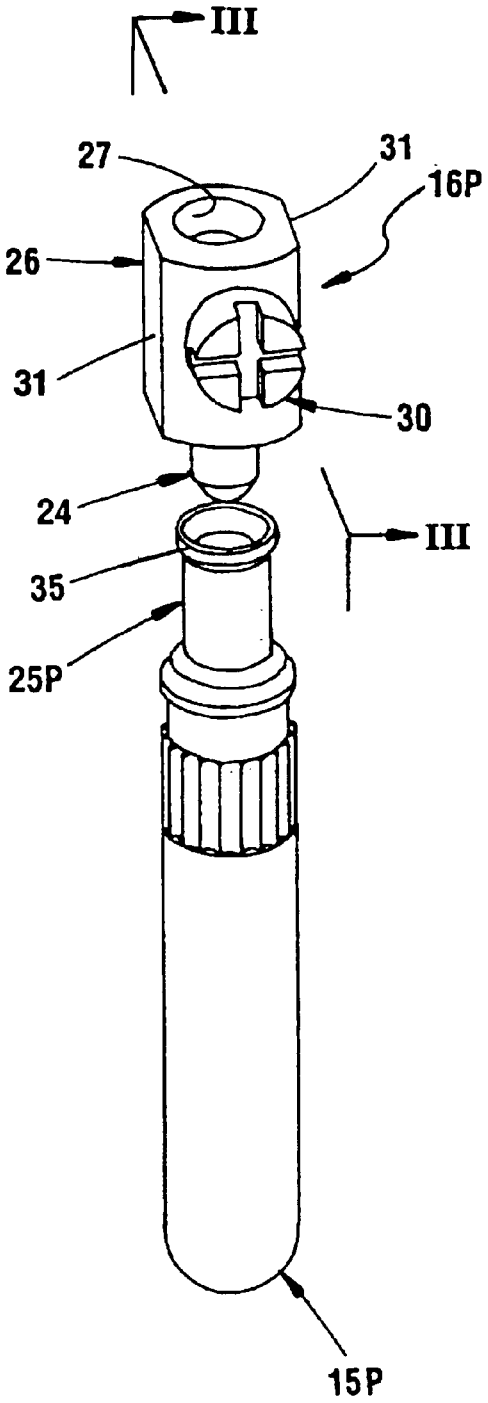
FIG. 2 is an exploded perspective view to a larger scale of one of the contact members of that mechanism, together with an associated connecting terminal.
Figure 3:
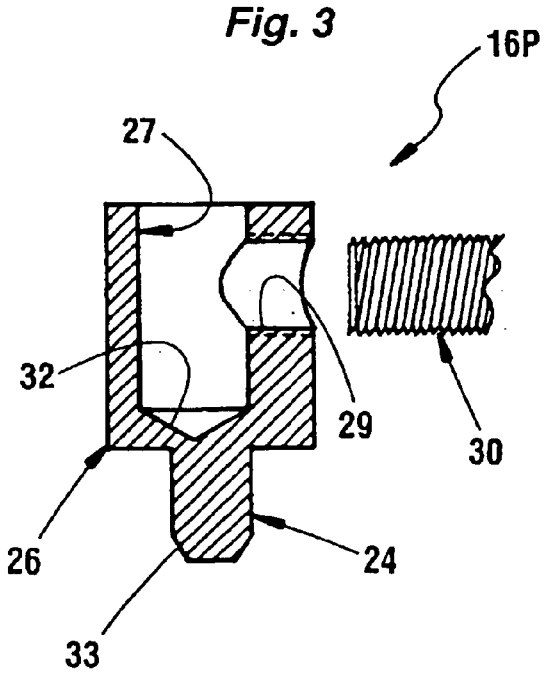
FIG. 3 is a partial view of the connecting terminal to a still larger scale and in axial section taken along the line III—III in FIG. 2.

As shown in more detail in FIG. 2, when the contact member 15P is a pin the tubular member 25P is at the end of the pin 15P and open at the end opposite the pin.

In the embodiment shown the tubular member 25P has a closed contour in cross section.

In this embodiment, the tubular member 25P forms at its outlet a flared flange 35 to facilitate further inserting the tail 24 of the associated connecting terminal 16P.

Figure 4:
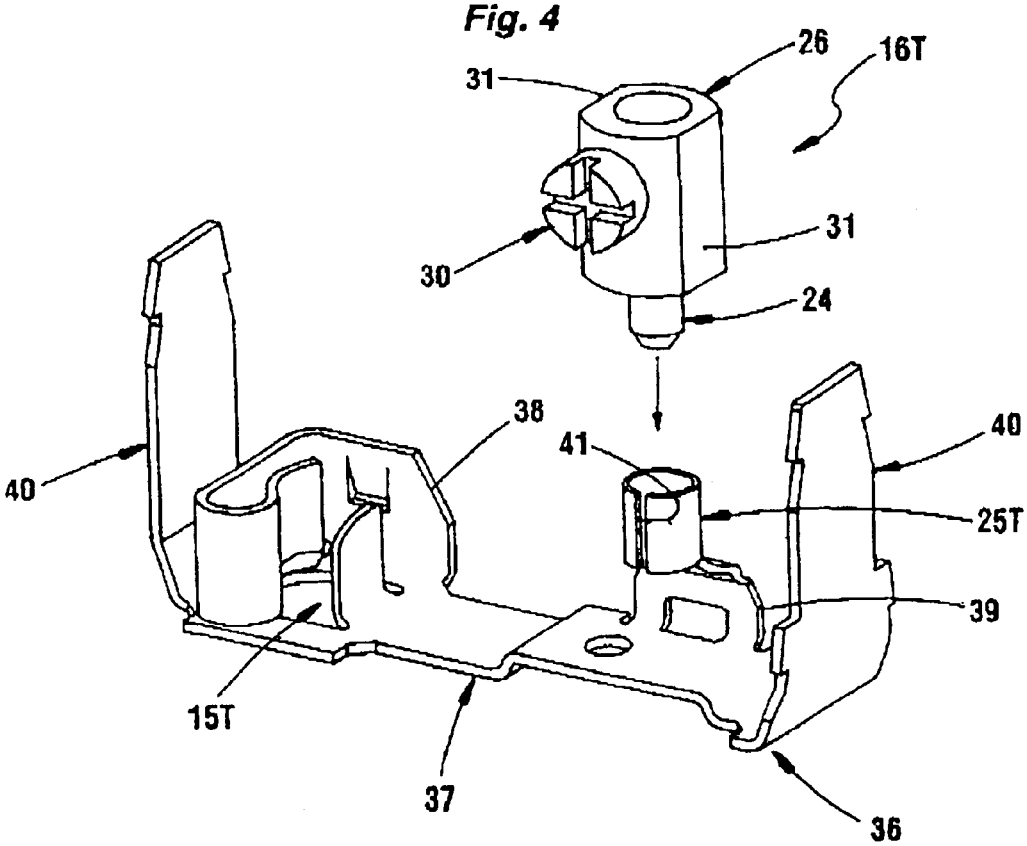
FIG. 4 is a perspective view analogous to that of FIG. 2 and relating to another contact member of the line connector concerned.

When, as shown in FIG. 4, the contact member 15T is a receptacle, the associated tubular member 25T is part of a common metal blank 36 cut and bent to shape.

In the embodiment shown, the metal blank 36 is generally U-shaped with a middle portion 37 from one edge of which run two spaced flats 38, 39, of which the former is part of the contact member 15T and the latter constitutes the tubular member 25T, and two lateral flanges 40 with a harpoon configuration adapted to anchor the contact member into the insulative material block 12 and/or the cover associated with it.

In the embodiment shown the tubular member 25T has a contour in cross section interrupted by a slot 41.

As shown here, for example, the slot runs its entire height and along one of its generatrices.

The tubular member 25T can therefore advantageously have some radial elasticity.

In practice, the resulting tubular member 25T is the result of rolling a portion of the corresponding flat 39 of the metal blank 36 into the form of a cylinder.

The outside diameter of the tail 24 of the connecting terminals 16P, 16T is substantially equal to (in practice slightly greater than) the inside diameter of the tubular members 25T, 25P.

During assembly, it is therefore necessary to apply thrust to the connecting terminals 16P, 16T to force their tails 24 into the tubular members 25P, 25T.

This firmly and securely fixes the connecting terminals 16P, 16T to the tubular members 25P, 25T and a firm and secure electrical contact is therefore made between the connecting terminals 16P, 16T and the tubular members 25P, 25T.

To improve this mechanical retention and electrical contact, the tubular members 25P, 25T can be crimped to the tails 24 of the connecting terminals 16P, 16T, if required.

With the same aim in view, the tail 24 can have a particular surface configuration.

For example the tail 24 can be knurled or striated, rather than smooth as shown.

In a variant that is also not shown the tubular members 252 of the contact members 152 have a contour in cross section interrupted by a slot 42, like the tubular member 25T associated with the contact member 15T, especially if, instead of being solid, as shown, the pin constituting the contact member 152 is hollow, being formed by cutting and rolling, for example, like the tubular member 25T.

Be this as it may, when the connecting terminals 16P, 16T are used, as described above, the bore 20 of the housings 19P of the connecting terminals 16P provides access to the screw 30 thereof, in practice allowing the insertion of a screwdriver.

Obviously, if the line connector 10 concerned must be non-demountable, the connecting terminals 16P, 16T are omitted and the connections to the corresponding electrical conductors are made simply by crimping the tubular members 25P, 25T to the previously bared ends of the conductive cores of the conductors.

Of course, the present invention is not limited to the embodiment described and shown, but encompasses any variant execution.

In particular, instead of being screw terminals, the connecting terminals employed can be of some other type, for example direct insertion terminals or insulation displacement terminals, wherever this is possible and/or permissible.

Also, the field of application of the invention is not limited to the situation in which the line connector is a plug, but equally encompasses the situation in which it is a socket outlet or a multisocket outlet.

What is claimed:

1. A cable socket for mounting on and electrical connection with an electric cable, comprising:

a plurality of receptacle type contact members for receiving complementary pin type contact members of a plug, a plurality of connecting terminals, each of said connecting terminals being electrically connected to a respective said receptacle type contact member, and each of said plurality of contact members comprising a tubular member, each of said connecting terminals comprising a tail, each of said tails being selectively connectable to an electrical conductor of the electric cable, the tails and tubular members being constructed and proportioned with respect to each other so as to provide a forceable engagement and each of said tubular members also is selectively connectable to an electrical conductor of the electric cable when the respective contact member is out of engagement with the respective tubular member, the tubular members being crimpable for selectively securing a respective electrical conductor of the electric cable thereto.

2. A cable plug for mounting on and electrical connection with an electrical cable, comprising:

a plurality of pin type contact members for engagement with complementary receptable type contact members of a socket, a plurality of connecting terminals, each of said connecting terminals being electrically connected to a respective one of said pin type contact members, each of said plurality of pin type contact members comprising a tubular member, each of said plurality of the connecting terminals comprising a tail, each of the tails being selectively connectable to an electrical conductor of the electric cable, the tails and tubular members being constructed and proportioned with respect to each other so as to provide a forceable engagement, each of said tubular members also selectively connectable to an electrical conductor of the electric cable when the respective contact member is out of engagement with the respective tubular member and the tubular members being also crimpable for selectively securing a respective electrical conductor of the electric cable thereto.

3. The cable socket claimed in claim 1, wherein said connecting terminal is a screw terminal having a body incorporating a bore and a transverse screwthreaded bore receiving a screw.

4. The cable socket claimed in claim 3, wherein said tail is parallel to said bore.

5. The cable socket claimed in claim 4, wherein said tail extends from a blind end of said bore.

6. The cable socket claimed in claim 3, wherein said tail is tapered at a free end thereof.

7. The cable socket claimed in claim 1, wherein said tubular member is in one piece with said contact member.

8. The cable socket claimed in claim 7, wherein said contact member is a pin and said tubular member is at an end thereof.

9. The cable socket claimed in claim 7, wherein said tubular member is part of a cut and bent metal blank.

10. The cable socket claimed in claim 1, wherein said tubular member has a closed contour in cross section.

11. The cable socket claimed in claim 1, wherein said tubular member has a slotted contour.

12. The cable plug claimed in claim 2, wherein said connecting terminal is a screw terminal having a body incorporating a bore and a transverse screwthreaded bore receiving a screw.

13. The cable plug claimed in claim 2, wherein said tail is parallel to said bore.

14. The cable plug claimed in claim 13, wherein said tail extends from a blind end of said bore.

15. The cable plug claimed in claim 12, wherein said tail is tapered at a free end thereof.

16. The cable plug claimed in claim 2, wherein said tubular member is in one piece with said contact member.

17. The cable plug claimed in claim 16, wherein said contact member is a pin and said tubular member is at its end.

18. The cable plug claimed in claim 16, wherein said tubular member is part of a cut and bent metal blank.

19. The cable plug claimed in claim 2, wherein said tubular member has a closed contour in cross section.

20. The cable plug claimed in claim 2, wherein said tubular member has a slotted contour.

* * * * *